US008768583B2

(12) United States Patent
Hargrave, Jr. et al.

(10) Patent No.: US 8,768,583 B2
(45) Date of Patent: Jul. 1, 2014

(54) COLLISION DETECTION AND MITIGATION SYSTEMS AND METHODS FOR A SHOVEL

(71) Applicant: Harnischfeger Technologies, Inc., Wilmington, DE (US)

(72) Inventors: Brian K. Hargrave, Jr., Mequon, WI (US); Mark M. Flees, Brookfield, WI (US); Kamal Kishore Gupta, Milwaukee, WI (US); Matthew J. Reiland, Mequon, WI (US); Steven Koxlien, Waukesha, WI (US); Wesley P. Taylor, Glendale, WI (US); Ryan A. Munoz, Glendale, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 13/804,951

(22) Filed: Mar. 14, 2013

(65) Prior Publication Data

US 2013/0261903 A1 Oct. 3, 2013

Related U.S. Application Data

(60) Provisional application No. 61/617,516, filed on Mar. 29, 2012, provisional application No. 61/763,229, filed on Feb. 11, 2013.

(51) Int. Cl.

| | |
|---|---|
| ***B60T 7/22*** | (2006.01) |
| ***E02F 9/20*** | (2006.01) |
| *B60W 30/16* | (2012.01) |

(52) U.S. Cl.

CPC ..... *E02F 9/2033* (2013.01)
USPC ..... 701/50; 701/301; 340/436

(58) Field of Classification Search

CPC ..... E02F 9/20; E02F 9/2033; E02F 9/2037; B60T 7/22; B60W 30/16
USPC ..... 701/50, 300, 301, 302; 340/903, 436, 340/435

See application file for complete search history.

(56) References Cited

U.S. PATENT DOCUMENTS 5,528,498 A 6/1996 Scholl
5,815,960 A * 10/1998 Soczka ..... 37/445

(Continued)

FOREIGN PATENT DOCUMENTS

AU 2010201626 11/2010
FR 2883534 9/2006

(Continued)

OTHER PUBLICATIONS

Hitachi "Hitachi introduces SkyAngle Advanced Peripheral Vision Support System at MINExpo International", http://hitachiconstruction.com/hitachi-introduces-skyangle-advanced-peripheral-vision-support-system-at-minexpo-international.html, webpage available as early as Sep. 24, 2013.

(Continued)

*Primary Examiner* — Tan Q Nguyen
(74) *Attorney, Agent, or Firm* — Michael Best & Friedrich LLP

(57) ABSTRACT

Systems and methods for detecting collisions. One system includes a processor configured to receive data from at least one sensor installed on a shovel, identify a plurality of planes based on the data, determine if the plurality of planes are positioned in a predetermined configuration associated with a haul truck to identify whether the plurality of planes represent a haul truck. The processor is further configured to receive a current position and a current direction of movement of a dipper of the shovel, and determine if a collision is possible between the dipper and the identified haul truck based on the plurality of planes, the current position, and the current direction of movement and without receiving any information from the haul truck. If a collision is possible, the processor is configured to alert an operator of the shovel and, optionally, augment movement of the dipper.

26 Claims, 10 Drawing Sheets
(5 of 10 Drawing Sheet(s) Filed in Color)

(56) References Cited

U.S. PATENT DOCUMENTS

| | | | | |
|---|---|---|---|---|
| 6,247,538 | B1 | 6/2001 | Takeda et al. | |
| 6,363,632 | B1 | 4/2002 | Stentz et al. | |
| 6,483,429 | B1 | 11/2002 | Yasui et al. | |
| 6,608,913 | B1 | 8/2003 | Hinton et al. | |
| 6,898,495 | B2 | 5/2005 | Tanaka et al. | |
| 6,917,378 | B2 | 7/2005 | Weis et al. | |
| 7,069,128 | B2 | 6/2006 | Iwama | |
| 7,088,262 | B2 | 8/2006 | Schindler et al. | |
| 7,161,616 | B1 | 1/2007 | Okamoto et al. | |
| 7,230,640 | B2 | 6/2007 | Regensburger et al. | |
| 7,268,676 | B2 | 9/2007 | Irvine | |
| 7,272,477 | B2 | 9/2007 | Oki et al. | |
| 7,307,655 | B1 | 12/2007 | Okamoto et al. | |
| 7,574,821 | B2 | 8/2009 | Furem | |
| 7,578,079 | B2 | 8/2009 | Furem | |
| 7,603,235 | B2 | 10/2009 | Mäkelä et al. | |
| 7,659,835 | B2 | 2/2010 | Jung | |
| 7,680,570 | B2 | 3/2010 | Mori | |
| 7,684,593 | B2 | 3/2010 | Chinomi | |
| 7,832,126 | B2 | 11/2010 | Koellner et al. | |
| 7,903,843 | B2 | 3/2011 | Sawaki et al. | |
| 7,969,326 | B2 | 6/2011 | Sakakibara | |
| 8,081,211 | B2 | 12/2011 | Chou et al. | |
| 8,130,271 | B2 | 3/2012 | Imamura | |
| 8,170,787 | B2 | 5/2012 | Coats et al. | |
| 8,207,868 | B2 | 6/2012 | Watanabe | |
| 8,289,189 | B2 | 10/2012 | Becker et al. | |
| 8,289,391 | B2 | 10/2012 | Kioyohara et al. | |
| 8,299,942 | B2 | 10/2012 | Ko et al. | |
| 8,319,614 | B2 | 11/2012 | Takano | |
| 8,330,816 | B2 | 12/2012 | Imamura | |
| 8,346,512 | B2 * | 1/2013 | McAree | 703/1 |
| 8,620,533 | B2 * | 12/2013 | Taylor | 701/50 |
| 2007/0057816 | A1 | 3/2007 | Sakakibara et al. | |
| 2010/0134593 | A1 | 6/2010 | Kakinami | |
| 2010/0220189 | A1 | 9/2010 | Yanagi | |
| 2010/0223008 | A1 | 9/2010 | Dunbabin et al. | |
| 2010/0238051 | A1 | 9/2010 | Suzuki et al. | |
| 2010/0274474 | A1 | 10/2010 | Takano | |
| 2011/0095910 | A1 | 4/2011 | Takano | |
| 2011/0106380 | A1 | 5/2011 | Wang et al. | |
| 2011/0181441 | A1 | 7/2011 | Ma et al. | |
| 2011/0210868 | A1 | 9/2011 | Yano et al. | |
| 2011/0234761 | A1 | 9/2011 | Yumiba et al. | |
| 2011/0257929 | A1 | 10/2011 | Ritchter et al. | |
| 2012/0194355 | A1 | 8/2012 | Thomas et al. | |
| 2012/0245798 | A1 | 9/2012 | Coats et al. | |
| 2012/0327261 | A1 | 12/2012 | Tafazoli Bilandi et al. | |

FOREIGN PATENT DOCUMENTS

| | | |
|---|---|---|
| JP | 2221525 | 9/1990 |
| JP | 8160127 | 6/1996 |
| JP | 2001064992 | 3/2001 |
| JP | 2008083786 | 4/2008 |
| JP | 2008085446 | 4/2008 |
| JP | 20081416143 | 6/2008 |
| JP | 2010187161 | 8/2010 |
| JP | 2010204821 | 9/2010 |
| KR | 2009030574 | 3/2009 |
| KR | 2011117984 | 10/2011 |
| WO | 2008102225 | 8/2008 |
| WO | 2012019931 | 2/2010 |
| WO | 2011158955 | 12/2011 |
| WO | 2012053105 | 4/2012 |

OTHER PUBLICATIONS

Motion Metrics International Corp. "Shovel Solutions, Proximity Detection" http://www.motionmetrics.com/shovels/?section=ProximityDetection, webpage available as early as Aug. 31, 2012.

Hitachi, "Hitachi Construction Machinery Jointly Develops Overview Monitoring System with Clarion" http://www.hitachi-c-m.com/global/news/press/PR20110121124945507.html, webpage available as early as Jan. 24, 2011.

Leica Geosystems "Leica Geosystems Machine Control" http://www.leica-geosystems.us/en/index.htm, website available as early as Jun. 12, 2009.

Co-pending U.S. Appl. No. 13/826,547, filed Mar. 14, 2013.

Nieto Vega, Abstract of Development of a real-time proximity warning and three-dimensional mapping system based on wireless network, virtual reality graphics, and GPS to improve safety in open-pit mines (2001) 0803753, 1 page.

Kise et al., Abstract of an Obstacle Identification Algorithm for a Laser Range Finder-based Obstacle Detection (2005) 48.3, 1 page.

Teizer et al., Abstract of Autonomous pro-active real-time construction worker and equipment operator proximity safety alert system (2010) 19.5, 1 page.

* cited by examiner

COLLISION DETECTION AND MITIGATION SYSTEMS AND METHODS FOR A SHOVEL

RELATED APPLICATIONS

The present application claims priority to U.S. Provisional Application No. 61/617,516, filed Mar. 29, 2012, and U.S. Provisional Application No. 61/763,229, filed Feb. 11, 2013, the entire contents of which are both incorporated by reference herein.

BACKGROUND

Embodiments of the present invention relate to detecting collisions between an industrial machine, such as an electric rope or power shovel, and detected physical objects located around the industrial machine.

SUMMARY

Industrial machines, such as electric rope or power shovels, draglines, etc., are used to execute digging operations to remove material from, for example, a bank of a mine. An operator controls a rope shovel during a dig operation to load a dipper with material. The operator deposits the material from the dipper into a haul truck. After depositing the material, the dig cycle continues and the operator swings the dipper back to the bank to perform additional digging.

As the dipper moves, it is important to have a clear swing path to avoid impact with other objects. For example, the dipper can impact the haul truck or other equipment in the swing path. The dipper can also impact the bank, the ground, other portions of the shovel, and/or other objects located around the shovel. The impact, especially if strong, can cause damage to the dipper and the impacted object. In addition, the impact can cause damage to other components of the shovel.

Accordingly, embodiments of the invention provide systems and methods for detecting and mitigating shovel collisions. To detect collisions, the systems and methods detect objects within an area around a shovel. After detecting objects, the systems and methods can optionally augment control of the shovel to mitigate the impact of possible collisions with the detected objects. When mitigating a collision, the systems and methods can provide alerts to the shovel operator using audible, visual, and/or haptic feedback.

In particular, one embodiment of the invention provides a system for detecting collisions. The system includes at least one processor. The at least one processor is configured to receive data from at least one sensor installed on a shovel relating to an area around the shovel, identify a plurality of planes based on the data, and determine if the plurality of planes are positioned in a predetermined configuration associated with a haul truck. If the plurality of planes are positioned in the predetermined configuration, the at least one processor is configured to identify the plurality of planes as representing a haul truck. The at least one processor is further configured to receive a current position and a current direction of movement of a dipper of the shovel and determine if a collision is possible between the dipper and the identified haul truck based on the plurality of planes, the current position, and the current direction of movement and without receiving any information from the haul truck. If a collision is possible, the at least one processor is configured to alert an operator of the shovel.

Another embodiment of the invention provides a method of detecting collisions between an industrial machine and at least one physical object located around the industrial machine. The method comprising receiving, at at least one processor, data from at least one sensor installed on the industrial machine, wherein the sensor collects data regarding at least a portion of the surroundings of the industrial machine. The method further includes identifying, at the at least one processor, a plurality of planes based on the data and determining, at the at least one processor, if the plurality of planes are positioned in a predetermined configuration associated with a predetermined physical object. In addition, the method includes identifying, at the at least one processor, the plurality of planes as representing the predetermined physical object if the plurality of planes are positioned in the predetermined configuration. Furthermore, the method includes receiving, at the at least one processor, a current position and a current direction of movement of at least one moveable component of the industrial machine, and determining, at the at least one processor, if a collision is possible between the at least one movable component and the identified predetermined physical object based on the plurality of planes, the current position, and the current direction of movement. The method also includes alerting an operator of the industrial machine if a collision is possible.

Other aspects of the invention will become apparent by consideration of the detailed description and accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
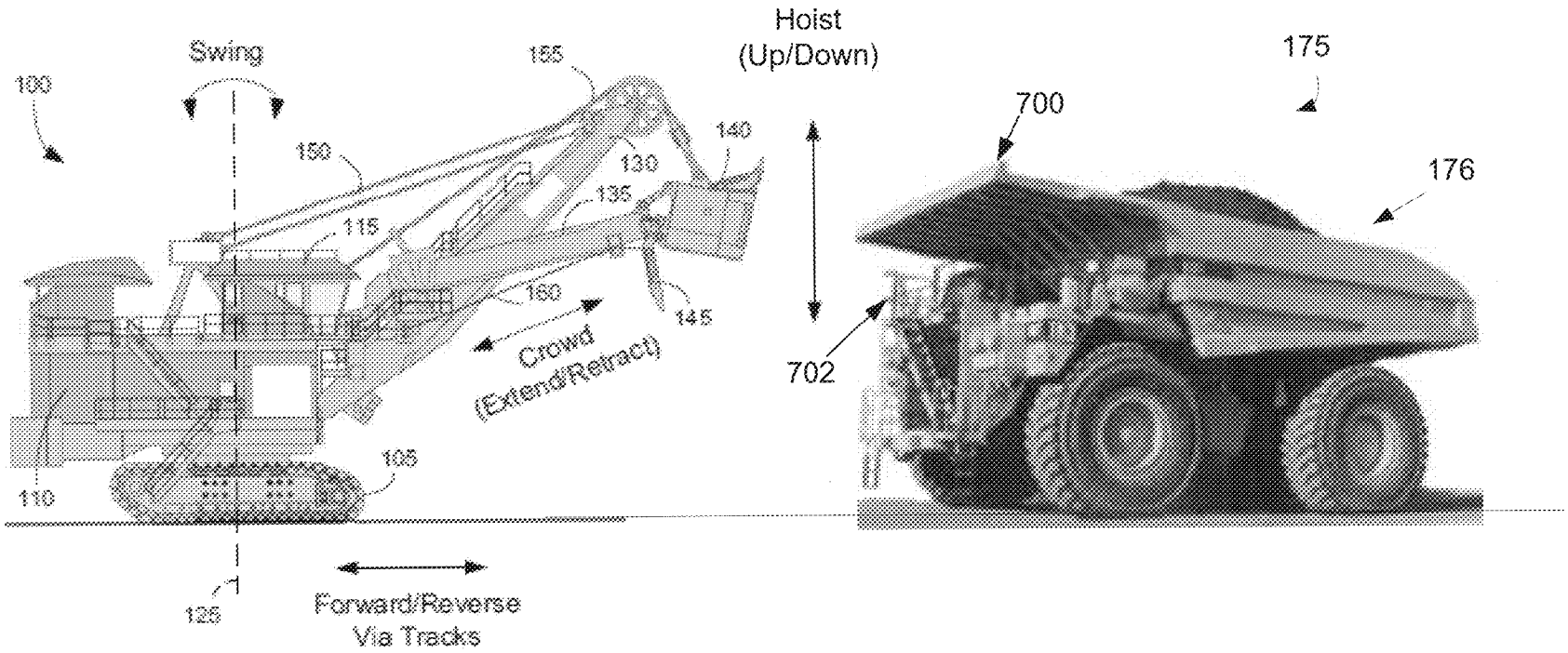
FIG. 1 illustrates an industrial machine and a haul truck according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items.

The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

FIG. 1 depicts an exemplary rope shovel 100. The rope shovel 100 includes tracks 105 for propelling the rope shovel 100 forward and backward, and for turning the rope shovel 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location and back to a digging location. In some embodiments, movement of the tracks 105 is not necessary for the swing motion. The rope shovel further includes a dipper shaft or boom 130 supporting a pivotable dipper handle 135 and a dipper 140. The dipper 140 includes a door 145 for dumping contents contained within the dipper 140 into a dump location.

The shovel 100 also includes taut suspension cables 150 coupled between the base 110 and boom 130 for supporting the dipper shaft 130; a hoist cable 155 attached to a winch (not shown) within the base 110 for winding the cable 155 to raise and lower the dipper 140; and a dipper door cable 160 attached to another winch (not shown) for opening the door 145 of the dipper 140. In some instances, the shovel 100 is a P&H® 4100 series shovel produced by P&H Mining Equipment Inc., although the shovel 100 can be another type or model of electric mining equipment.

When the tracks 105 of the mining shovel 100 are static, the dipper 140 is operable to move based on three control actions, hoist, crowd, and swing. Hoist control raises and lowers the dipper 140 by winding and unwinding the hoist cable 155. Crowd control extends and retracts the position of the handle 135 and dipper 140. In one embodiment, the handle 135 and dipper 140 are crowded by using a rack and pinion system. In another embodiment, the handle 135 and dipper 140 are crowded using a hydraulic drive system. The swing control swivels the handle 135 relative to the swing axis 125. During operation, an operator controls the dipper 140 to dig earthen material from a dig location, swing the dipper 140 to a dump location, release the door 145 to dump the earthen material, and tuck the dipper 140, which causes the door 145 to close, and swing the dipper 140 to the same or another dig location.

FIG. 1 also depicts a haul truck 175. During operation, the rope shovel 100 dumps material contained within the dipper 140 into the haul truck bed 176 by opening the door 145. Although the rope shovel 100 is described as being used with the haul truck 175, the rope shovel 100 is also able to dump material from the dipper 140 into other material collectors, such as a mobile mining crusher, or directly onto the ground.

As described above in the summary section, as an operator swings the dipper 140, the dipper 140 can collide with other objects, such as a haul truck 175 (e.g., the bed 176 of the haul truck 175) and other components of the shovel 100 (e.g., the tracks 105, a counterweight located at the rear of the shovel 100, etc.). These collisions (e.g., metal-on-metal impacts) can cause damage to the dipper 140, the shovel 100, and the impacted object. Therefore, the shovel 100 includes a controller that detects objects and augments control of the dipper 140 to mitigate a collision between the dipper 140 and a detected object.

Figure 2:
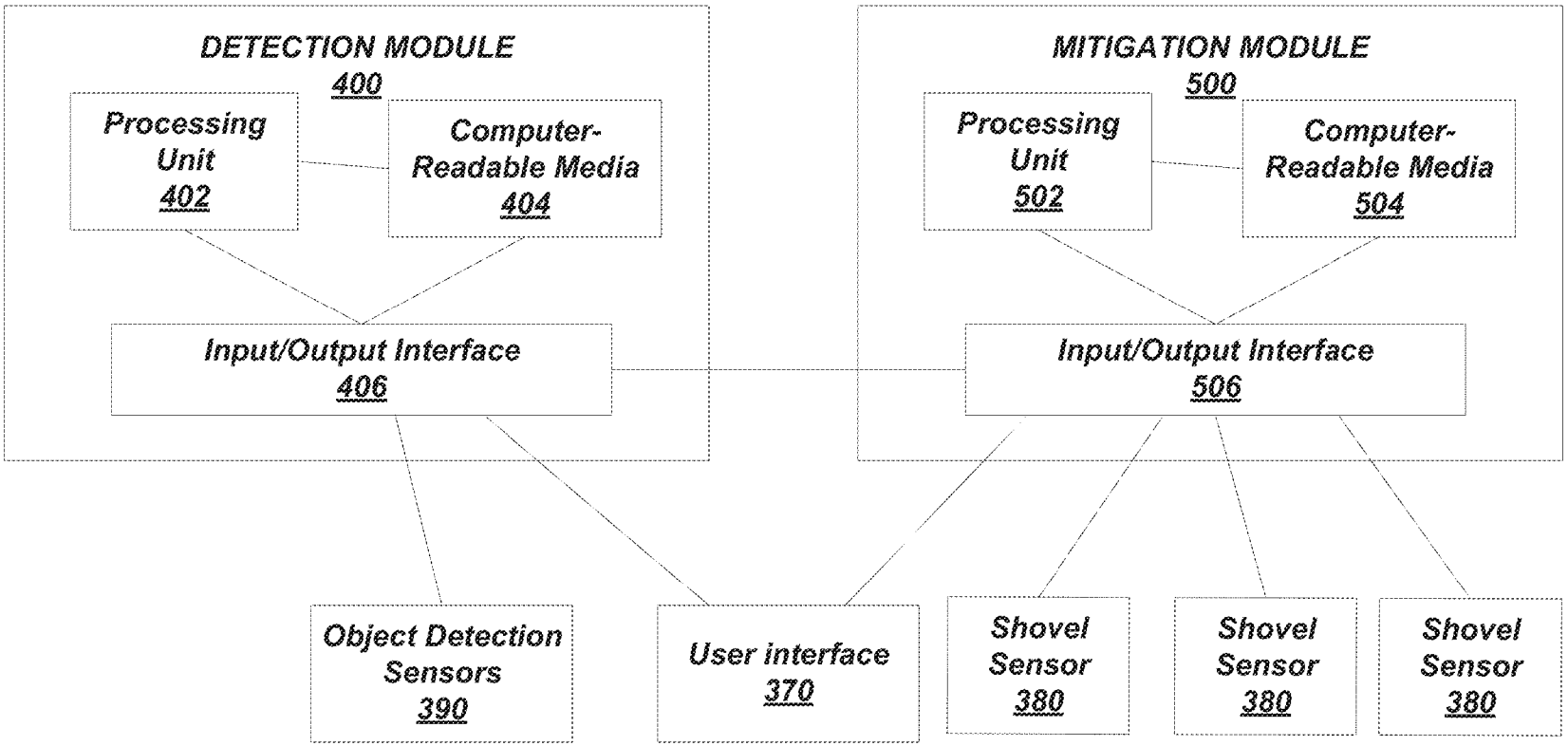
FIG. 2 illustrates a controller for the industrial machine of FIG. 1.

The controller includes combinations of hardware and software that are operable to, among other things, monitor operation of the shovel 100 and augment control of the shovel 100, if applicable. A controller 300 according to one embodiment of the invention is illustrated in FIG. 2. As illustrated in FIG. 2, the controller 300 includes a detection module 400 and a mitigation module 500. The detection module 400 includes, among other things, a processing unit 402 (e.g., a microprocessor, a microcontroller, or another suitable programmable device), non-transitory computer-readable media 404, and an input/output interface 406. The processing unit 402, the memory 404, and the input/output interface 406 are connected by one or more control and/or data buses (e.g., a common bus 408). Similarly, the mitigation module 500 includes, among other things, a processing unit 502 (e.g., a microprocessor, a microcontroller, or another suitable programmable device), non-transitory computer-readable media 504, and an input/output interface 506. The processing unit 502, the memory 504, and the input/output interface 506 are connected by one or more control and/or data buses (e.g., a common bus 508). It should be understood that in other constructions, the detection module 400 and/or the mitigation module 500 includes additional, fewer, or different components.

As described below in more detail, the detection module 400 detects objects and provides information about detected objects to the mitigation module 500. The mitigation module 500 uses the information from the detection module 400 and other information regarding the shovel 100 (e.g., current position, motion, etc.) to identify or detect possible collisions and, optionally, mitigate the collisions. It should be understood that the functionality of the controller 300 can be distributed between the detection module 400 and the mitigation module 500 in various configurations. For example, in some embodiments, alternatively or in addition to the functionality of the mitigation module 500, the detection module 400 detects possible collisions based on detected objects (and other information regarding the shovel 100 received directly or indirectly through the mitigation module 500) and provides warnings to an operator. The detection module 400 can also provide information regarding identified possible collisions to the mitigation module 500, and the mitigation module 500 can use the information to automatically mitigate the collisions.

Separating the controller 300 into the detection module 400 and the mitigation module 500 allows the functionality of each module to be used independently and in various configurations. For example, the detection module 400 can be used without the mitigation module 500 to detect objects, detect collisions, and/or provide warnings to an operator. In addition, the mitigation module 500 can be configured to receive data from multiple detection modules 400 (e.g., each detection module 400 detects particular objects or a particular area around the shovel 100). Furthermore, by separating the controller 300 between the two modules, each module can be tested individually to ensure that the module is operating properly.

The computer-readable media 404 and 504 store program instructions and data. The processors 402 and 502 included in each module 400 and 500 are configured to retrieve instructions from the media 404 and 504 and execute, among other things, the instructions to perform the control processes and methods described herein. The input/output interface 406 and 506 of each module 400 and 500 transmits data from the module to external systems, networks, and/or devices and receives data from external systems, networks, and/or devices. The input/output interfaces 406 and 506 can also store data received from external sources to the media 404 and 504 and/or provide the data to the processors 402 and 502, respectively.

As illustrated in FIG. 2, the mitigation module 500 is in communication with a user interface 370. The user interface 370 allows a user to perform crowd control, swing control, hoist control, and door control. For example, the interface 370 can include one or more operator-controlled input devices, such as joysticks, levers, foot pedals, and other actuators. The user interface 370 receives operator input via the input devices and outputs digital motion commands to the mitigation module 500. The motion commands include, for example, hoist up, hoist down, crowd extend, crowd retract, swing clockwise, swing counterclockwise, dipper door release, left track forward, left track reverse, right track forward, and right track reverse. As will be explained in greater detail, the mitigation module 500 is configured to augment the operator motion commands. In some embodiments, the mitigation module 500 can also provide feedback to the operator through the user interface 370. For example, if the mitigation module 500 is augmenting operator control of the dipper 140, the mitigation module 500 can use the user interface 370 to notify the operator of the automated control (e.g., using visual, audible, or haptic feedback).

The mitigation module 500 is also in communication with a number of shovel position sensors 380 to monitor the location and status of the dipper 140 and/or other components of the shovel 100. For example, in some embodiments, the mitigation module 500 is coupled to one or more crowd sensors, swing sensors, hoist sensors, and shovel sensors. The crowd sensors indicate a level of extension or retraction of the handle 135 and the dipper 140. The swing sensors indicate a swing angle of the handle 135. The hoist sensors indicate a height of the dipper 140 based on a position of the hoist cable 155. The shovel sensors indicate whether the dipper door 145 is open (for dumping) or closed. The shovel sensors may also include weight sensors, acceleration sensors, and inclination sensors to provide additional information to the mitigation module 500 about the load within the dipper 140. In some embodiments, one or more of the crowd sensors, swing sensors, and hoist sensors are resolvers that indicate an absolute position or relative movement of the motors used to move the dipper 140 (e.g., a crowd motor, a swing motor, and/or a hoist motor). For instance, for indicating relative movement, as the hoist motor rotates to wind the hoist cable 155 to raise the dipper 140, the hoist sensors output a digital signal indicating an amount of rotation of the hoist and a direction of movement. The mitigation module 500 translates these outputs to a height position, speed, and/or acceleration of the dipper 140.

As illustrated in FIG. 2, in some embodiments, the detection module 400 is also in communication with the user interface 370. For example, the user interface 370 can include a display, and the detection module 400 can display indications of detected objects on the display. Alternatively or in addition, the detection module 400 can display warnings on the user interface 370 if the detection module 400 detects an object within a predetermined distance of the shovel 100 and/or if the detection module 400 detects a possible collision with a detected object. It should be understood that in some embodiments the display is separate from the user interface 370. In addition, in some embodiments, the display can be part of a console located remote from the shovel 100 and can be configured to communicate with the detection module 400 and/or the mitigation module 500 over one or more wired or wireless connections.

The detection module 400 is also in communication with a number of object detection sensors 390 for detecting objects. The sensors 390 can include digital cameras and/or laser scanners (e.g., 2-D or 3-D scanners). For example, in some embodiments, the sensors 390 include one or more SICK LD-MRS laser scanners. In other embodiments, alternatively or in addition, the sensors 390 include one or more TYSX G3 EVS AW stereo cameras. In embodiments where the sensors 390 include both laser scanners and cameras, the detection module 400 can use just the lasers scanners if the cameras are unavailable or are not functioning properly and vice versa. In some embodiments, the sensors 390 include at least three laser scanners. One scanner can be positioned on the left side (as viewed by a shovel operator) of the shovel 100 (to track dumping of material to the left of the shovel 100). A second scanner can be positioned on the right side (as viewed by a shovel operator) of the shovel 100 (to track dumping of material to the right of the shovel 100). A third scanner can be positioned on the rear of the shovel 100 to detect objects generally located behind the shovel 100 (e.g., that may collide with the counterweight at the rear of the shovel 100).

Figure 3:
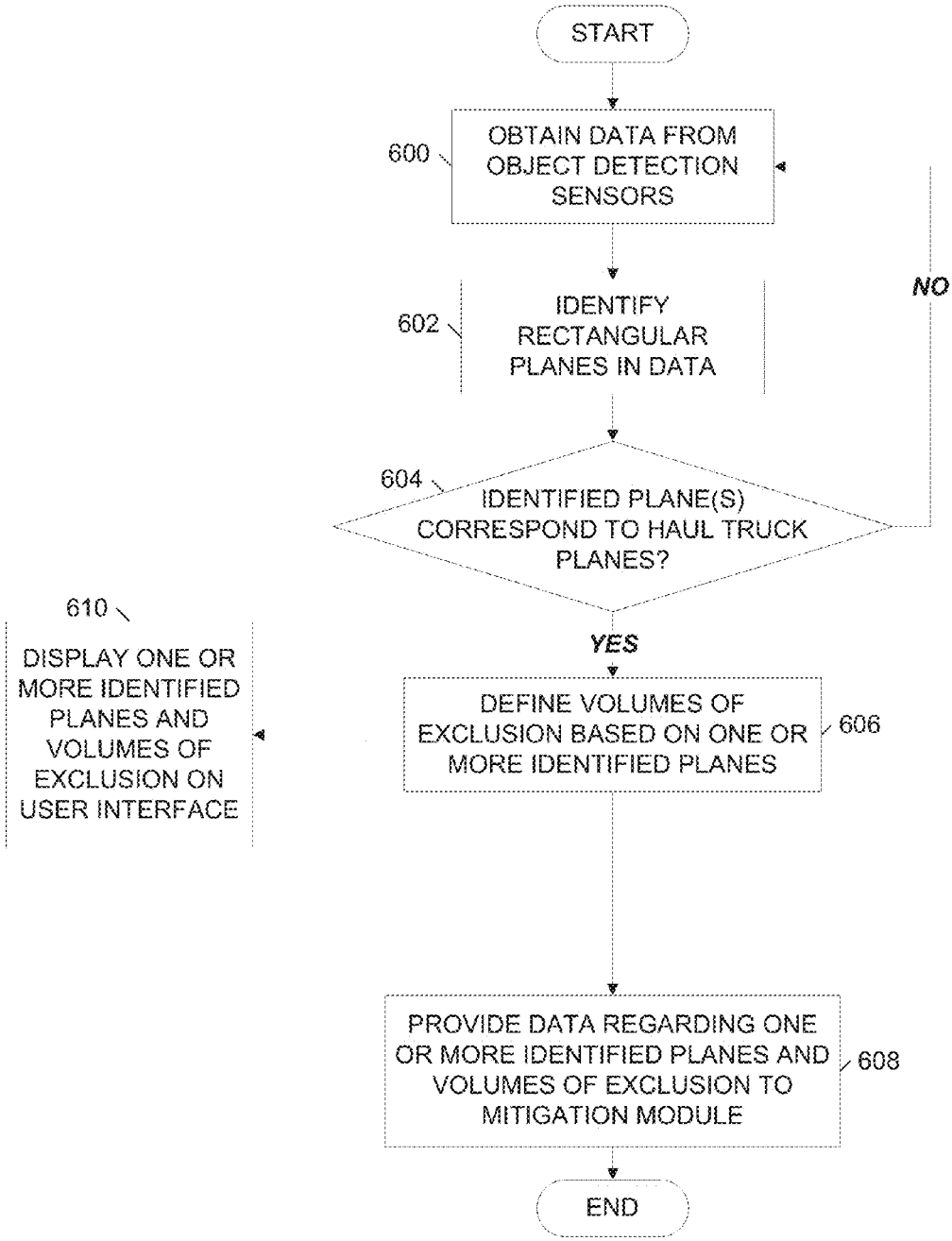
FIG. 3 is a flow chart illustrating a method of detecting objects performed by the controller of FIG. 2.

As noted above, the detection module 400 and the mitigation module 500 are configured to retrieve instructions from the media 404 and 504, respectively, and execute, among other things, the instructions related to perform control processes and methods for the shovel 100. For example, FIG. 3 is a flow chart illustrating an object detection method performed by the detection module 400. As illustrated in FIG. 3, the detection module 400 obtains data from the object detection sensors 390 (at 600) and identifies objects that could collide with the shovel 100 based on the data (e.g., objects that could collide with the dipper 140). In some embodiments, the detection module 400 executes a local detection method to look for objects in the immediate path of the dipper 140 (i.e., a predetermined region-of-interest around the shovel 100) that could collide with the dipper 140 as the dipper 140 moves. For example, within the local detection method, the detection module 400 can obtain data from the sensors 390 focused on the predetermined region-of-interest around and the shovel 100 (e.g., to the left or right of the dipper 140). In some embodiments, the local detection method also classifies detected objects, such as whether the detected object is part of the shovel 100 or not.

Alternatively or in addition, the detection module 400 executes a global detection method that maps the location of detected objects in the shovel surroundings. The global detection method can focus on a larger, predetermined region-of-interest than the region-of-interest associated with the local detection method. The global detection method can also attempt to recognize specific objects. For example, the global detection method can determine whether a detected object is part of a haul truck, part of the ground, part of a wall, etc.

In some embodiments, the detection module 400 is configured to detect particular objects, such as haul trucks 175. To detect the trucks 175, the detection module 400 identifies planes based on the data from the sensors 390 (at 602). In particular, the detection module 400 can be configured to identify one or more horizontal and/or vertical planes in a configuration commonly associated with a haul truck 175. For example, as illustrated in FIG. 1, a haul truck 175 commonly includes an approximately horizontal header 700 that extends over a cab 702 of the truck 175. The haul truck 175 also includes an approximately horizontal bed 176. In addition, a haul truck 175 typically includes a vertical front plane, two vertical side planes, and a vertical rear plane. Accordingly, the detection module 400 can be configured to identify a plurality of planes based on the data supplied by the sensors 390 that could correspond to the front, sides, rear, header 700, and bed 176 of a haul truck 175.

Figure 4:
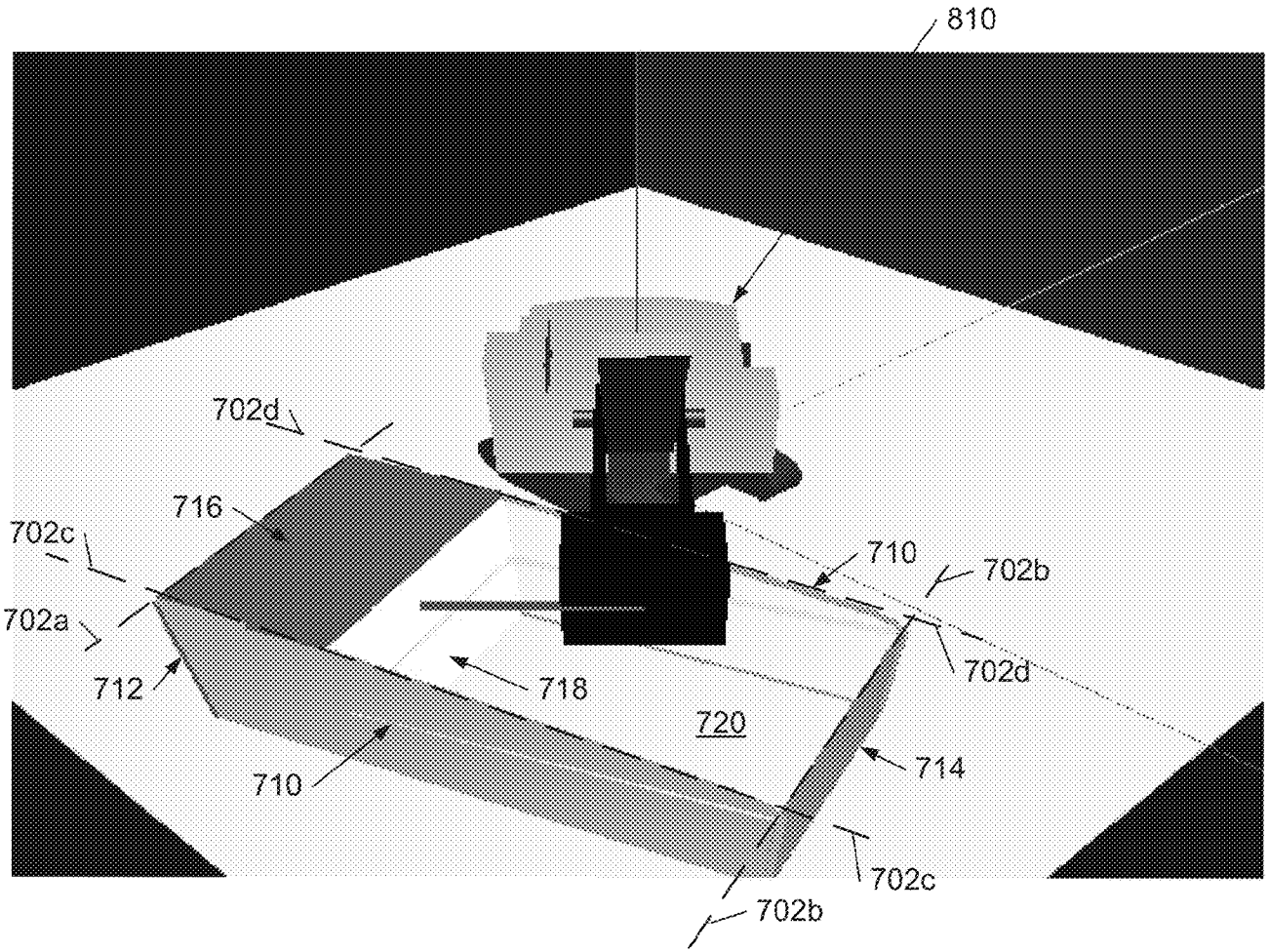
FIG. 4 illustrates exemplary planes detected by the controller of FIG. 2.

For example, as illustrated in FIG. 4, an area of a haul truck 175 can be defined by a plurality of bounding lines 702. The bounding lines 702 include a front bounding line 702*a* defining a front end of the truck 175, a rear bounding line 702*b* defining a rear end of the truck 175, a far bounding line 702*c* defining a first side of the truck 175 farther from the shovel 100, and a near bounding line 702*d* defining a second side of the truck nearer to the shovel 100. The haul truck 175 can also be defined by a header line 704 that marks a rear edge of the header 700.

The lines 702 and 704 define various planes that make up the truck 175. In particular, as illustrated in FIG. 4, the front bounding line 702*a*, the far bounding line 702*c*, and the rear bounding line 702*b* define a far sidewall plane 706. Similarly, the front bounding line 702*a*, the near bounding line 702*d*, and the rear bounding line 702*b* define a near sidewall plane 710. The front bounding line 702*a*, the far bounding line 702*c*, and the near bounding line 702*d* also define a front plane 712, and the rear bounding line 702*b*, the far bounding line 702*c*, and the near bounding line 702*d* also define a rear plane 714.

In addition, the header line 704, the front bounding line 702*a*, the far bounding line 702*c*, and the near bounding line 702*d* define a top header plane 716. The header line 704, the far bounding line 702*c*, and the near bounding line 702*d* also define a side header plane 718. Also, the header line 704, the far bounding line 702*c*, the near bounding line 702*d*, and the rear bounding line 702*b* define a bed plane 720.

The detection module 400 is configured to identify a set of one or more of the planes illustrated in FIG. 4 from the data supplied by the object detection sensors 390 in a configuration that matches a configuration of planes associated with a haul truck 175. In some embodiments, the detection module 400 is configured to identify planes of a particular size. In other embodiments, the detection module 400 is configured to identify any approximately rectangular planes regardless of size. In still other embodiments, the detection module 400 is configured to identify any rectangular planes that exceed a predetermined size threshold. It should be understood that not all of the planes illustrated in FIG. 4 need to be detected for the detection module 400 to detect and identify a haul truck. For example, if a portion of the haul truck is outside of a range of the sensor 390 or does not exactly match the entire configuration of planes illustrated in FIG. 4 (e.g., has a curved header), the detection module 400 can still detect the truck if at least a minimum number of the planes are detected by the module 400 in the proper configuration (e.g., the front, rear, and bed planes). It should also be understood that although the planes are described in the present application as identifying haul trucks, the detection module 400 can be configured to detect particular planes or other shapes and associated configurations associated with other types of objects, such as the tracks 105, walls, people, the counterweight at the rear of the shovel 100, etc.

The detection module 400 uses the positions (and sizes) of identified planes to determine whether a detected object corresponds to a haul truck 175 (at 604). For example, in some embodiments, the detection module 400 is configured to detect planes from a point cloud in three-dimensional space (i.e., x-y-z). In particular, to identify planes, the module 400 initially removes all points below a predetermined height (i.e., below a predetermined z value). The module 400 then projects the remaining points onto a two-dimensional plane, which results in a binary two-dimensional image. The module 400 then performs blob detection on the binary two-dimensional image. Blob detection uses mathematical methods to detect regions within a digital image that differ in properties (e.g., brightness, color, etc.) from surrounding areas. Therefore, a detected region or "blob" is a region of a digital image in which some properties of the regions are constant or vary within a predetermined range of value (i.e., all points in the blob are similar).

After detecting all the blobs in the image, the detection module 400 eliminates any blobs that do not conform to a predetermined size (e.g., predetermined width/length ratio thresholds). The detection module 400 then performs line detection on each remaining blob to determine if the blob includes the four bounding lines 702 and the header line 704 commonly associated with a haul truck 175. If it does, the module 400 checks that the four bounding lines 702 form a rectangle (e.g., the front bounding line 702*a* and the rear bounding line 702*b* are parallel and perpendicular to the far bounding line 702*c* and the near bounding line 702*d*) and that the header line 704 is parallel to the front bounding line 702*a* and the rear bounding line 702*b*. Using the location of the four bounding lines 702 in the point cloud, the detection module 400 then determines the height of the lines 702 (i.e., the z value). If the height of the lines indicates that the lines properly define an approximately horizontal rectangle that fits the predetermined length/width ratio thresholds (i.e., no line is in an unexpected z plane), the module 400 projects each of the lines 702 and 704 in the height direction (i.e., z direction) to the ground to form a plane in three-dimensional space. In particular, the planes include the front plane 712, the far sidewall plane 706, the near sidewall plane 710, the rear plane 714, and the side header plane 718. The module 400 also projects a plane from the header line 704 to the front plane 712, which defines the top header plane 716. In addition, the module 400 projects a plane from the top height of the rear plane 714 to half of the height under the header line 704, which forms the bed plane 720.

After identifying the planes of the haul truck 175, the detection module 400 can define the position, size, and orientation of the haul truck 175 based on the planes. In some embodiments, the detection module 400 uses a grid to track the position, location, and orientation of identified objects (e.g., identified planes). The detection module 400 can provide the grid to the mitigation module 500, and the mitigation module 500 can use the grid to determine possible collisions between the dipper 140 and detected haul trucks 175 and, optionally, mitigate the collisions accordingly.

Figure 5:
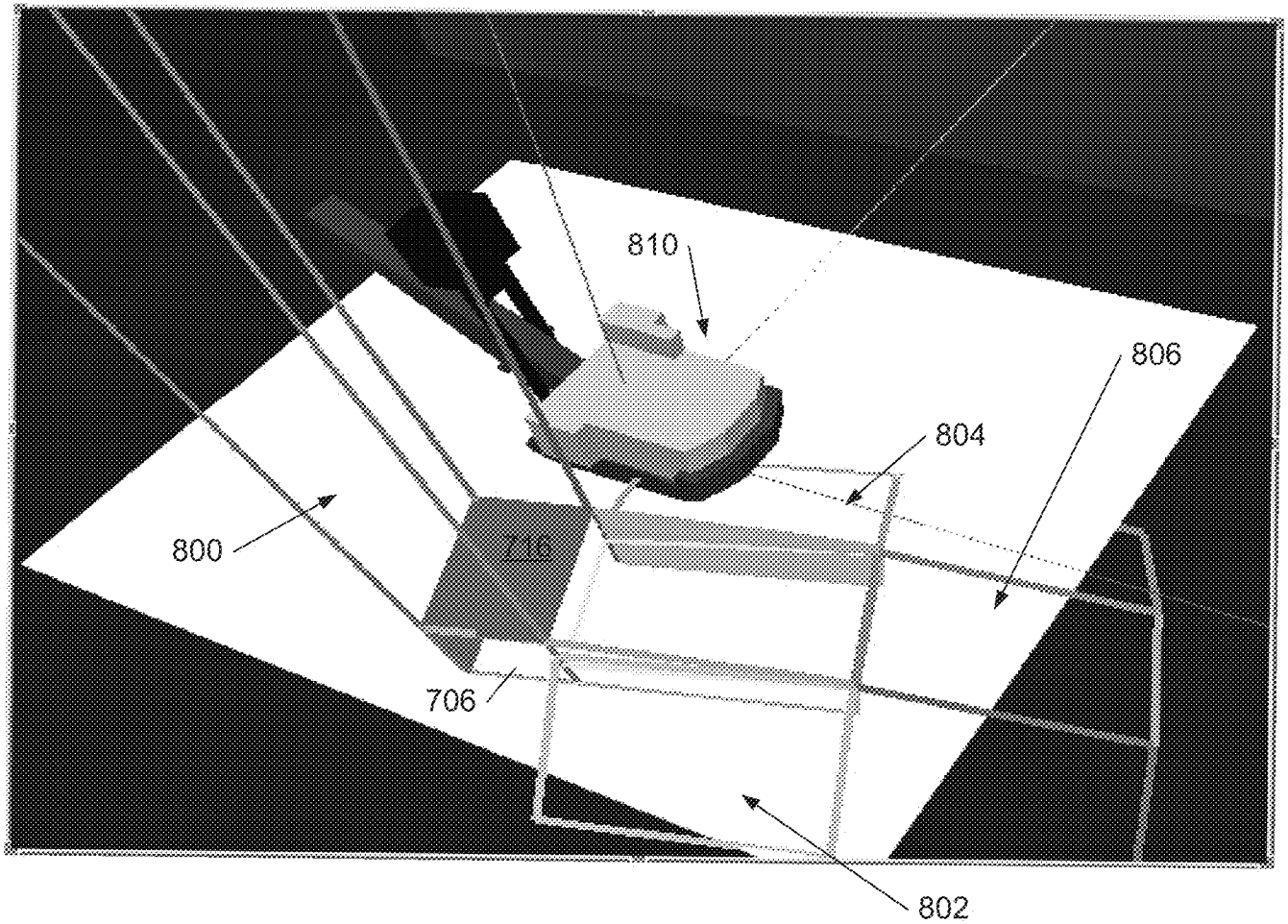
FIG. 5 illustrates exemplary volumes of exclusion defined by the controller of FIG. 2 based on the planes of FIG. 4.

In some embodiments, the detection module 400 also defines volumes of exclusion based on the planes of identified haul trucks 175 (at 606). For example, depending on a particular plane identified by the detection module 400 as representing a haul truck 175, the detection module 400 defines a volume including the plane that marks an area around the haul truck 175 that the shovel 100 (e.g., the dipper 140) should not enter. For example, FIG. 5 illustrates volumes of exclusions defined by the detection module 400 for the planes illustrated in FIG. 4. As illustrated in FIG. 5, the volume of exclusion 800 including the header plane 716 is cube-shaped and extends upward from the plane infinitely. Therefore, the volume of exclusion 800 indicates that no part of the shovel 100 should be positioned above the header 700 (e.g., to protect an operator in the cab 702).

Similarly, the detection module 400 can define a volume of exclusion for the far sidewall plane 706 and the near sidewall plane 710. For example, as illustrated in FIG. 5, the volume 802 including the far sidewall plane 706 is triangular-shaped and extends outward from the far side of the truck 175 to the ground. The volume 802 is shaped as illustrated in FIG. 5 to indicate that the closer the dipper 140 gets to the side of the truck 175 the dipper 140 should be raised to a height greater than the side of the truck 175 to mitigate a collision with the far side of the truck 175. As illustrated in FIG. 5, the detection module 400 can generate a similarly-shaped volume of exclusion 804 that includes the near sidewall plane 710. As also illustrated in FIG. 5, the detection module 400 can define a volume of exclusion 806 containing the rear plane 714. For example, as illustrated in FIG. 5, the volume 806 includes the rear plane 714, is trapezoidal-shaped, and extends outward from the rear and sides of the truck 175 toward the ground. The volume 804 is shaped as illustrated in FIG. 5 to indicate that as the dipper 140 approaches the rear of the truck 175, the dipper 140 should be raised to mitigate a collision with the rear of the truck 175. It should be understood that in some embodiments in addition to or as an alternative, the detection module 400 can define volumes of inclusion based on the identified planes that define zones within which the shovel 100 can safely operate.

In some embodiments, after the detection module 400 detects one or more planes, the detection module 400 can lock the planes. In this situation, the detection module 400 no longer attempts to detect or identify objects. However, the locked planes can be used to test the mitigation module 500 even with the detected object removed. For example, after a haul truck 175 is detected at a particular position, the haul truck 175 can be physically removed while the mitigation module 500 is tested to determine if the module 500 successfully augments control of the dipper 140 to avoid a collision with the truck 175 based on the locked position of the truck 175 previously detected by the detection module 400. In this regard, the functionality of the mitigation module 500 can be tested without risking damage to the shovel 100 or the haul truck 175 if the mitigation module 500 malfunctions.

Returning to FIG. 3, the detection module 400 provides data regarding the detected objects (e.g., the identified planes and the volumes of exclusion) to the mitigation module 500 (at 608). In some embodiments, the detection module 400 also provides data regarding the detected objects to the user interface 370 (or a separate display local to or remote from the shovel 100) (at 610). The user interface 370 can display information to a user regarding the detected objects. For example, the user interface 370 can display the planes and/or the volumes of exclusion identified by the detection module 400 as illustrated in FIGS. 4 and 5. As illustrated in FIG. 4, the user interface 370 can display the truck planes currently detected by the detection module 400 in the correct position with respect to the shovel 100. The user interface 370 can also selectively display the volumes of exclusion (as illustrated in FIG. 5). In some embodiments, the user interface 370 also displays a three-dimensional representation 810 of the shovel 100. In particular, the user interface 370 can display a representation 810 of the shovel 100 that indicates the X, Y, and Z location of the dipper, the handle angle, and the current swing angle or direction of the dipper 140. The current position and motion of the shovel 100 can be obtained from the mitigation module 500, which, as described below, obtains the current status of the shovel 100 to determine possible collisions. The position of detected objects can be updated on the user interface 370 as updated data is received from the detection module 400 (e.g., substantially continuously), and, similarly, the current position of the shovel 100 as illustrated by the representation 810 can be updated on the user interface as updated data is received from the mitigation module 500 (e.g., substantially continuously).

Figure 6:
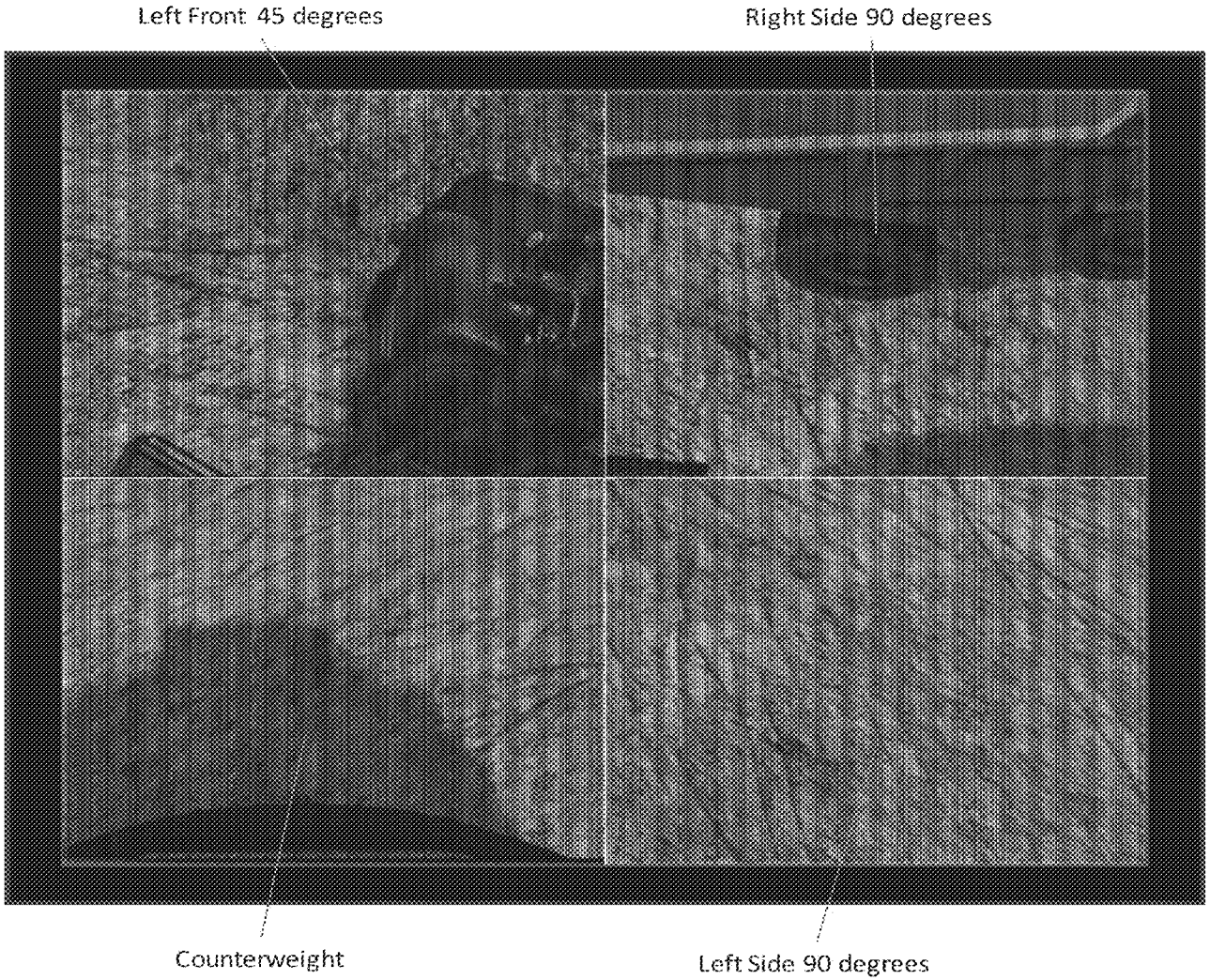
FIG. 6 illustrates images captured around an industrial machine.
Figure 7:
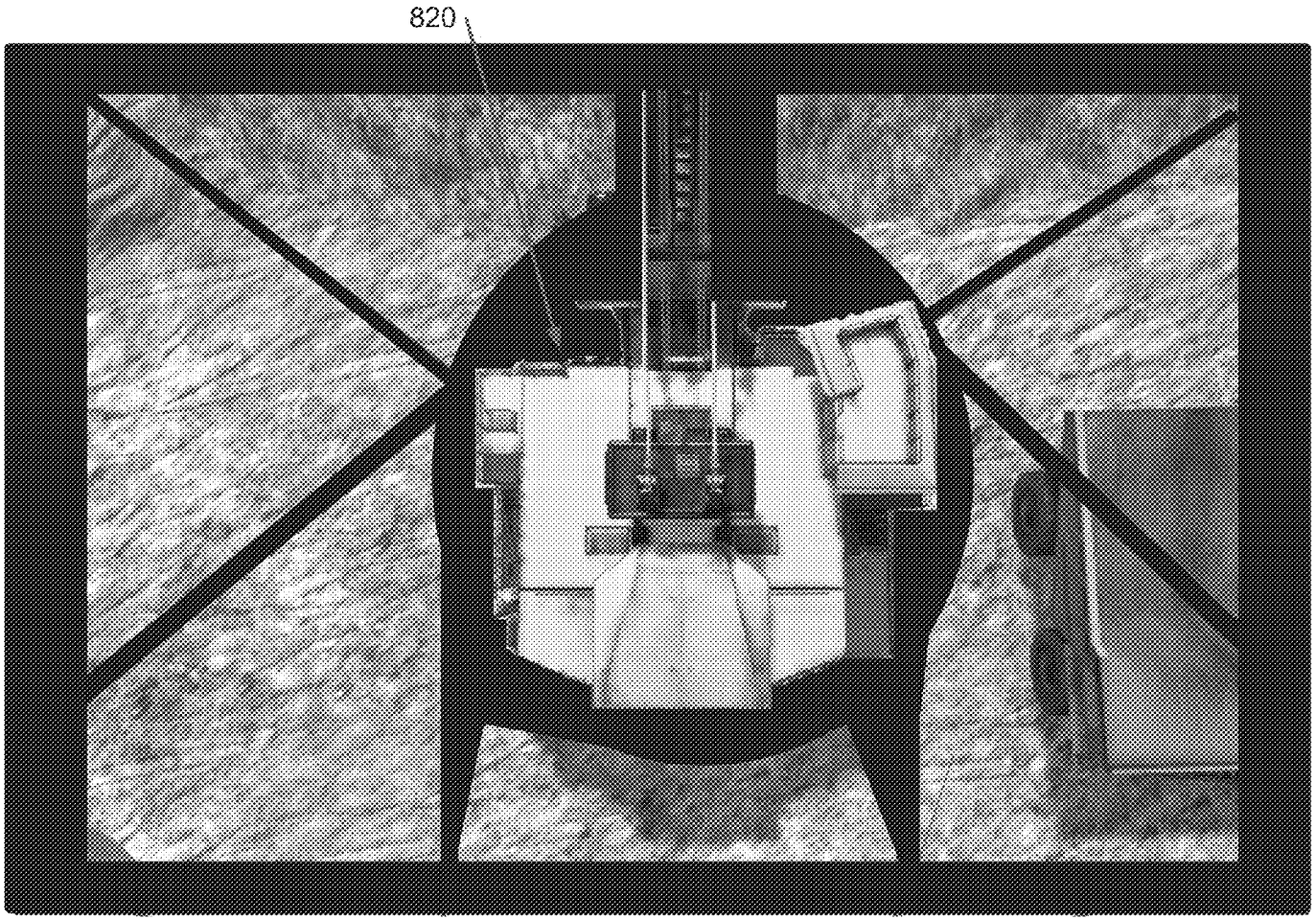
FIG. 7 illustrates an overhead view of the industrial machine based on the images of FIG. 6.

The planes and/or volumes of exclusions can be displayed in various ways. For example, in some embodiments, the user interface 370 superimposes the detected planes on a camera view of an area adjacent to the shovel 100. In particular, one or more still or video cameras including a wide-angle lens, such as a fisheye lens, can be mounted on the shovel 100 and can be used to capture an image of one or more areas around the shovel 100. For example, FIG. 6 illustrates four images captured around a shovel using four digital cameras. The image from each camera can be unwrapped (e.g., flattened) and a three-dimensional transformation can be applied to the unwrapped image to generate an overhead view of the shovel 100, as illustrated in FIG. 7.

Figure 8:
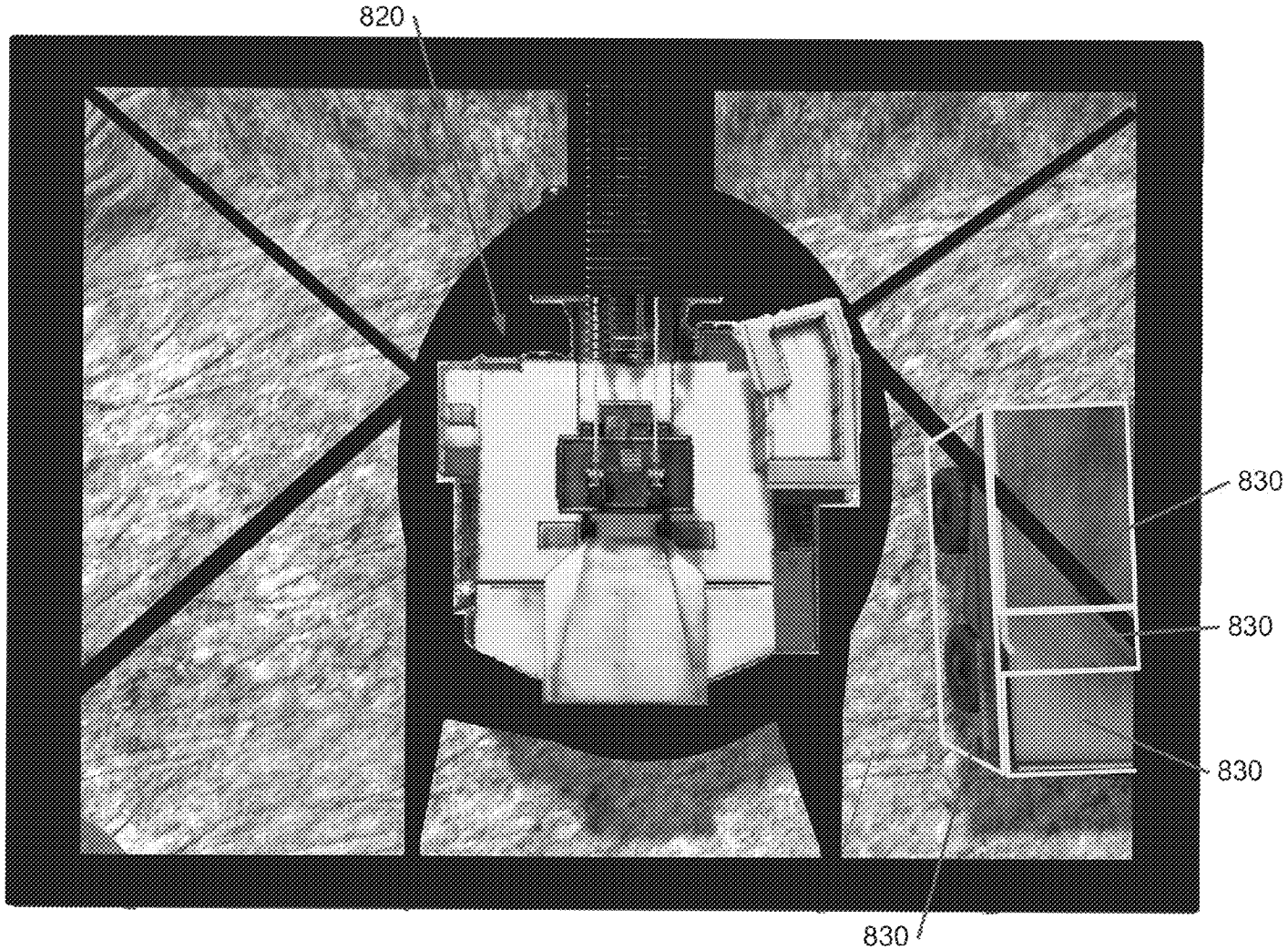
FIG. 8 illustrates the overhead view of FIG. 7 superimposed with planes detected by the controller of FIG. 2.

The overhead view can also include a graphical representation 820 of the shovel 100 from an overhead view. In some embodiments, the representation 820 can be modified based on the current status of the shovel 100 (e.g., the current swing angle of the dipper 140). The planes and/or the volumes of exclusions determined by the detection module 400 can be superimposed on the overhead view of the shovel 100. For example, as illustrated in FIG. 8, planes 830 identified by the detection module 400 as representing a haul truck can be superimposed on the overhead view based on the position of the identified haul truck 175 with respect to the shovel 100. An operator or other viewer can use the overhead image and superimposed planes 830 to (i) verify whether a detected object is truly a haul truck and (ii) quickly ascertain the current position of the shovel 100 with respect to an identified haul truck or other detected objects. In some embodiments, features of the superimposed planes 830 (e.g., shape, size, color, animation, etc.) can be used to convey information about detected objects. For example, if a haul truck 175 is positioned within a predetermined danger zone defined around the shovel 100 (e.g., 0 to 10 feet from the shovel), the planes 830 can be colored red. Otherwise, the planes 830 can be colored yellow. Furthermore, detected planes 830 representing boulders, walls, people, and other non-truck objects can be displayed in a color different than the color of the detected planes 830 representing a haul truck 175. Using different colors and other features of superimposed planes 830 can provide a shovel operator with a quick reference of the shovel's surroundings even if the operator is only viewing the displayed planes 830 or other images through his or her peripheral vision.

Figure 9:
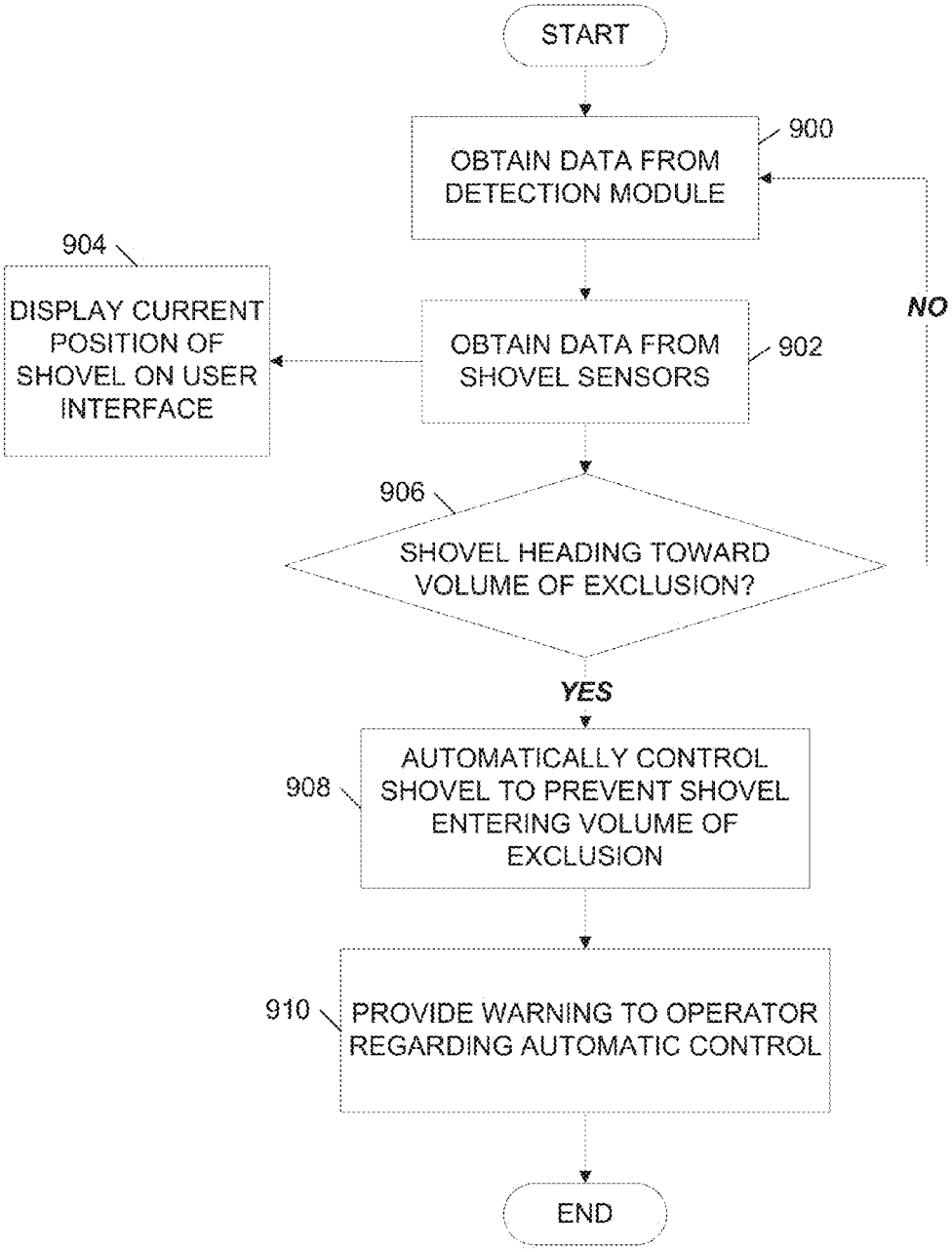
FIG. 9 is a flow chart illustrating a method of mitigating collisions performed by the controller of FIG. 2.

FIG. 9 illustrates a method of mitigating collisions performed by the mitigation module 500. As illustrated in FIG. 9, the mitigation module 500 obtains data regarding detected objects (e.g., position, size, dimensions, classification, planes, volumes of exclusion, etc.) from the detection module 400 (at 900). The mitigation module 500 also obtains data from the shovel position sensors 380 and the user interface 370 (at 902). The mitigation module 500 uses the obtained data to determine a current position of the shovel 100 (e.g., the dipper 140) and any current movement of the shovel (e.g., the dipper 140). As noted above, in some embodiments, the mitigation module 500 provides information regarding the current position and direction of travel or movement of the shovel 100 to the detection module 400 and/or the user interface 370 for display to a user (at 904).

The mitigation module 500 also uses the current position and direction of travel or movement of the shovel 100 to identify possible collisions between a portion of the shovel 100, such as the dipper 140, and a detected object (at 906). In some embodiments, the mitigation module identifies a possible collision based on whether the dipper 140 is headed toward and is currently positioned within a predetermined distance from a detected object or a volume of exclusive associated with the detected object. For example, the mitigation module 500 identifies a velocity vector of the dipper 140. In some embodiments, the velocity vector is associated with a ball pin of the dipper 140. In other embodiments, the module 500 identifies multiple velocity vectors, such as a vector for a plurality of outer points of the dipper 140. The mitigation module 500 can generate the one or more velocity vectors based on forward kinematics of the shovel 100. After generating the one or more velocity vectors, the module 500 performs geometric calculations to extend the velocity vectors infinitely and determine if any vector intersects any of the planes identified by the detection module 400 (see FIG. 4). In other embodiments, the module 500 performs geometric calculations to determine if any vector intersects any of the volumes of exclusions identified by the detection module 400 (see FIG. 5).

If there is an intersection, the module 500 identifies that a collision is possible. When the mitigation module 500 determines that a collision is possible, the mitigation module 500 can generate one or more alerts (e.g., audio, visual, or haptic) and issue the alerts to the shovel operator. The mitigation module 500 can also optionally augment control of the shovel 100 to prevent a collision or reduce the impact speed of a collision with the detected object (at 908). In particular, the mitigation module 500 can apply a force field that slows the dipper 140 when it is too close to a detected object. The mitigation module 500 can also apply a velocity limit field that limits the speed of the dipper 140 when it is close to a detected object.

For example, the module 500 can generate a repulsive field at the point of the identified intersection. The repulsive field modifies the motion command generated through the user interface 370 based on operator input. In particular, the mitigation module 500 applies a repulsive force to a motion command to reduce the command. For example, the mitigation module 500 receives a motion command, uses the repulsive field to determine how much to reduce the command, and outputs a new, modified motion command. One or more controllers included in the shovel 100 receive the motion command, or a portion thereof, and operate one or more components of the shovel based on the motion command. For example, a controller that swings the handle 135 swing the handle 135 as instructed in the motion command.

It should be understood that because the velocity vectors are extended infinitely, an intersection may be identified even when the dipper 140 is a large distance from the detected object. The repulsive field applied by the mitigation module 500, however, may be associated with a maximum radius and a minimum radius. If the detected intersection is outside of the maximum radius, the mitigation module 500 does not augment control of the shovel 100 and, thus, no collision mitigation occurs.

The repulsive field applies an increasing negative factor to the motion command as the dipper 140 moves closer to a center of the repulsive field. For example, when the dipper 140 first moves within the maximum radius of the repulsive force, the repulsive force reduces the motion command by a small amount, such as approximately 1%. As the dipper 140 moves closer to the center of the repulsive field, the repulsive field reduces the motion command by a greater amount until the dipper 140 is within the minimum radius of the force, where the reduction is approximately 100% and the dipper 140 is stopped. In some embodiments, the repulsive field is only applied to motion of the dipper 140 toward the detected object. Therefore, an operator can still manually move the dipper 140 away from the detected object. In some situations, the dipper 140 may be repulsed by multiple repulsive fields (e.g., associated with multiple detected objects or planes of a detected object). The multiple repulsive fields prevent the dipper 140 from moving in multiple directions. However, in most situations, the dipper 140 will still be able to be manually moved in at least one direction that allows the dipper 140 to be moved away from the detected object.

Therefore, the mitigation module 500 can prevent collisions between the shovel 100 and other object or can mitigate the force of such collisions and the resulting impacts. When preventing or mitigating a collision (e.g., by limiting movement of the shovel or limiting speed of movement of the shovel), the mitigation module 500 can provide alerts to the operator using audible, visual, or haptic feedback (at 910). The alerts inform the operator that the augmented control is part of collision mitigation control as compared to a malfunction of the shovel 100 (e.g., non-responsiveness of the dipper 140).

In some embodiments, unlike other collision detection systems, the systems and methods described in the present application do not require modifications to the detected objects, such as the haul truck 175. In particular, in some arrangements, no sensors or devices and related communications links are required to be installed on and used with the haul truck 175 to provide information to the shovel 100 about the location of the haul truck 175. For example, in some existing systems, visual fiducials and other passive/active position sensing equipment (e.g., GPS devices) are mounted on haul trucks, and a shovel uses information from this equipment to track the location of a haul truck. Eliminating the need for such modifications reduces the complexity of the systems and methods and reduces the cost of haul trucks 175.

Similarly, some existing collision detection systems require that the system be preprogrammed with the characteristics (e.g., image, size, dimensions, colors, etc.) of all available haul trucks (e.g., all makes, models, etc.). The detection systems use these preprogrammed characteristics to identify haul trucks. This type of preprogramming, however, increases the complexity of the system and requires extensive and frequent updates to detect all available haul trucks when new trucks are available or there are modifications to existing haul trucks. In contrast, as described above, the detection module 400 uses planes to identify a haul. Using planes and a configuration of planes commonly associated with a haul truck increases the accuracy of the detection module 400 and eliminates the need for extensive preprogramming and associated updates. In addition, by detecting objects based on more than just one characteristic, such as size, the detection module 400 more accurately detects haul trucks. For example, using the plane configuration described above, the detection module 400 can distinguish between haul trucks and other pieces of equipment or other parts of an environment similar in size to a haul truck (e.g., large boulders).

It should be understood that although the above functionality is related to detecting and mitigating collisions between the shovel 100 (i.e., the dipper 140) and a haul truck 175, the same functionality can be used to detect and/or mitigate collisions between any component of the shovel 100 and any type of object. For example, the functionality can be used to detect and/or mitigate collisions between the tracks 105 and the dipper 140, between the tracks 105 and objects located around the shovel 100 such as boulders or people, between the counterweight at the rear of the shovel 100 and objects located behind the shovel 100, etc. Also, it should be understood that the functionality of the controller 300 as described in the present application can be combined with other controllers to perform additional functionality. In addition or alternatively, the functionality of the controller 300 can also be distributed among more than one controller. Also, in some embodiments, the controller 300 can be operated in various modes. For example, in one mode, the controller 300 may detect potential collisions but may not augment control of the dipper 140 (i.e., only operate the detection module 400). In this mode, the controller 300 may log information about detected objects and/or detected possible collisions with detected objects and/or may alert the operator of the objects and/or the possible collisions.

Figure 10:
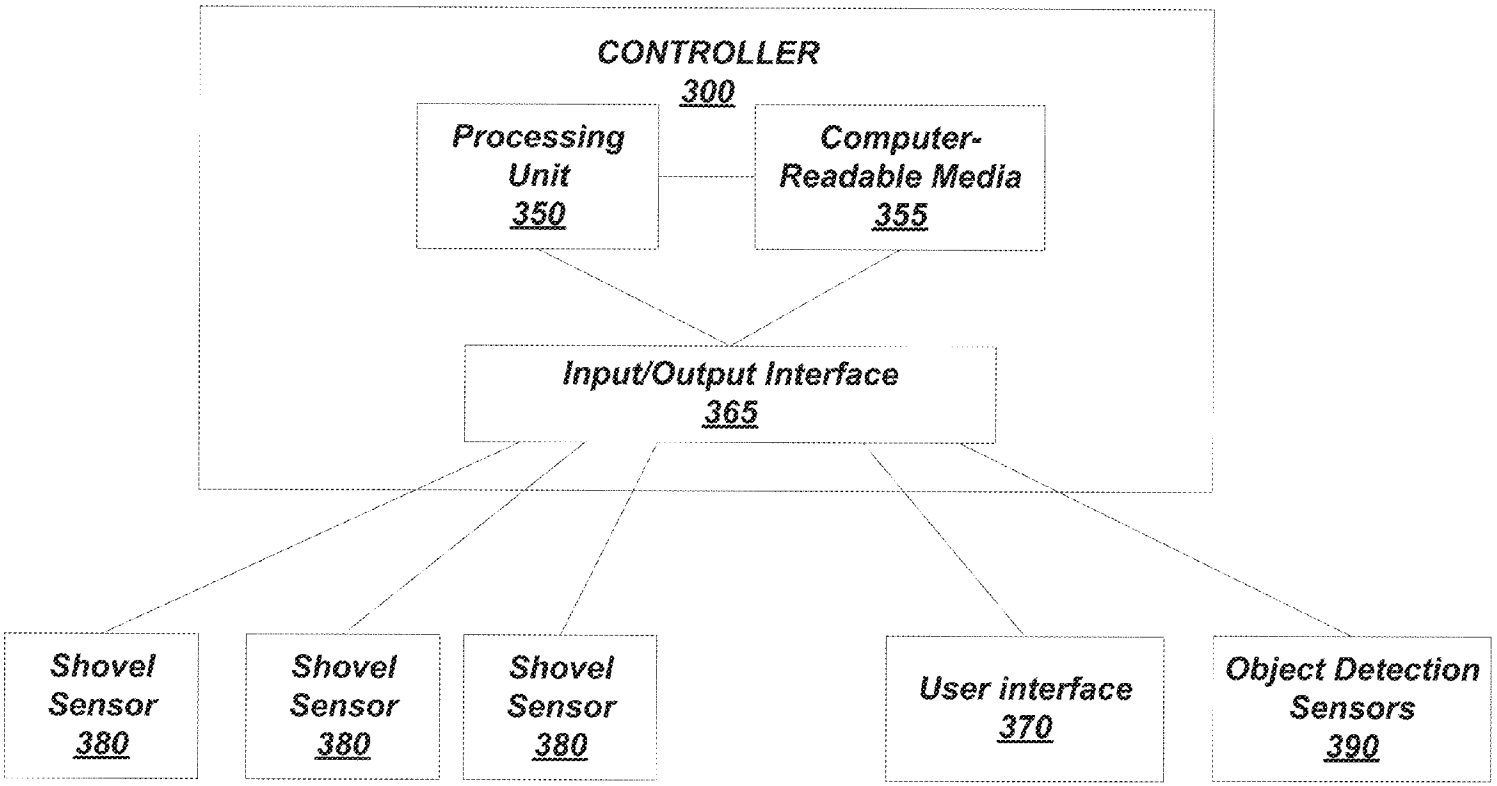
FIG. 10 illustrates a controller for an industrial machine according to another embodiment of the invention.

It should also be understood that although the functionality of the controller 300 is described above in terms of two modules (i.e., the detection module 400 and the mitigation module 500), the functionality can be distributed between the two modules in various configurations. Furthermore, in some embodiments, as illustrated in FIG. 10, the controller 300 includes a combined module that performs the functionality of detection module 400 and the mitigation module 500.

Various features and advantages of the invention are set forth in the following claims.

What is claimed is:

1. A system for detecting collisions between a shovel and a haul truck located around the shovel, the system comprising:

at least one processor configured to receive data from at least one sensor installed on the shovel, the data relating to an area around the shovel, identify a plurality of planes based on the data, determine if the plurality of planes are positioned in a predetermined configuration associated with a haul truck, if the plurality of planes are positioned in the predetermined configuration, identify the plurality of planes as representing a haul truck, receive a current position and a current direction of movement of a dipper of the shovel, determine if a collision is possible between the dipper and the identified haul truck based on the plurality of planes, the current position, and the current direction of movement and without receiving any information from the haul truck, and if a collision is possible, alert an operator of the shovel.

2. The system of claim 1, wherein the at least one processor is further configured to augment the current direction of movement of the dipper to mitigate the possible collision.

3. The system of claim 2, wherein the at least one processor is further configured to provide at least one alert to an operator of the shovel regarding the augmented control of the dipper.

4. The system of claim 1, wherein the at least one processor receives the current position of the dipper from at least one of a crowd sensor, a swing sensor, a hoist sensor, and dipper door sensor.

5. The system of claim 1, wherein the at least one processor receives the current direction of movement of the dipper from at least one operator-controlled input device for moving the dipper.

6. The system of claim 1, wherein the at least sensor includes at least one laser scanner.

7. The system of claim 1, wherein the at least one sensor includes at least one stereo camera.

8. The system of claim 1, wherein the at least one sensor includes at least one laser scanner and at least one stereo camera.

9. The system of claim 1, wherein the at least one processor is configured to identify the plurality of planes by identifying a plurality of lines based on the data and identifying the plurality of lines based on intersections between the plurality of lines.

10. The system of claim 1, wherein the at least one processor is configured to determine if the plurality of planes are positioned in the predetermined configuration includes determining if the plurality of planes includes a horizontal header plane, a horizontal truck bed plane, a vertical front plane, two vertical side planes, and a vertical rear plane.

11. The system of claim 1, wherein the at least one processor is further configured to identify at least one volume of exclusion based on one of the plurality of planes, the volume of exclusion extending from the one of the plurality of planes and defining a volume the dipper should not enter.

12. The system of claim 11, wherein the at least one processor is configured to identify a possible collision between the dipper and the haul truck when the dipper is positioned within the at least one volume of exclusion.

13. The system of claim 1, wherein the at least one processor is configured to identify a possible collision between the dipper and the haul truck when a velocity vector of the dipper based on the second data and the third data extended infinitely intersects with at least one of the plurality of planes.

14. The system of claim 13, wherein the at least one processor is further configured to generate a repulsive field for mitigating the possible collision, the repulsive field positioned at a point of intersection between the velocity vector and the at least one of the plurality of planes and having a maximum radius and apply the repulsive field to the third data to apply an increasing negative factor to the third data as the dipper moves closer to the point of intersection within the maximum radius.

15. The system of claim 14, wherein the repulsive force includes a minimum radius and wherein the at least one processor is configured to apply the repulsive field to the third data to stop the dipper when the dipper moves within the minimum radius.

16. A method of detecting collisions between an industrial machine and at least one physical object located around the industrial machine, the method comprising:

receiving, at at least one processor, data from at least one sensor installed on the industrial machine, the sensor collecting data regarding at least a portion of the surroundings of the industrial machine, identifying, at the at least one processor, a plurality of planes based on the data;

determining, at the at least one processor, if the plurality of planes are positioned in a predetermined configuration associated with a predetermined physical object;

if the plurality of planes are positioned in the predetermined configuration, identifying, at the at least one processor, the plurality of planes as representing the predetermined physical object;

receiving, at the at least one processor, a current position and a current direction of movement of at least one moveable component of the industrial machine;

determining, at the at least one processor, if a collision is possible between the at least one movable component and the identified predetermined physical object based on the plurality of planes, the current position, and the current direction of movement; and if a collision is possible, alerting an operator of the industrial machine.

17. The method of claim 16, further comprising, if a collision is possible, augmenting the current movement of the at least one movable component.

18. The method of claim 17, wherein augmenting the current movement of the at least one moveable component includes applying a repulsive field to the current movement of the at least one movable component, the repulsive field defining an increasing negative force to be applied to the current movement the closer the at least one moveable component moves to one of the plurality of planes.

19. The method of claim 17, wherein augmenting the current movement of the at least one movable component includes stopping movement of the at least one movable component toward one of the plurality of planes when the at least one movable component is within a predetermined distance of the one of the plurality of planes while allowing movement of the at least one movable component away from the one of the plurality of planes.

20. The method of claim 16, wherein receiving the data from the at least one sensor includes receiving the data from at least one laser scanner.

21. The method of claim 16, wherein receiving the data from the at least one sensor includes receiving the data from at least one stereo camera.

22. The method of claim 16, wherein receiving the data from the at least one sensor includes receiving the data from at least one laser scanner and at least one stereo camera.

23. The method of claim 16, wherein identifying the plurality of planes includes detecting a plurality of lines based on the data, wherein the plurality of lines includes a front bounding line, a first side bounding line, a second side bounding line, a rear bounding line, and a header line and defining the plurality of planes based on the intersections of the plurality of lines.

24. The method of claim 23, wherein determining if the plurality of planes are positioned in the predetermined configuration includes determining if the front bounding line, the first side bounding line, the second side bounding line, and the rear bounding lines approximately form a rectangle.

25. The method of claim 16, where determining if the plurality of planes are positioned in the predetermined configuration includes determining if the plurality of planes includes a horizontal header plane, a horizontal truck bed plane, a vertical front plane, two vertical side planes, and vertical rear plane.

26. The method of claim 16, wherein determining if a collision is possible includes determining a velocity vector of the at least one movable component based on the current position and the current direction of movement and determining if the velocity vector intersects with at least one of the plurality of planes.

* * * * *